US005442330A

United States Patent [19]

Fuller et al.

[11] Patent Number: 5,442,330

[45] Date of Patent: Aug. 15, 1995

[54] COUPLED LINE FILTER WITH IMPROVED OUT-OF-BAND REJECTION

[75] Inventors: Ronald D. Fuller, Mesa; Hugh R. Malone, Phoenix, both of Ariz.

[73] Assignee: Motorola, Inc., Schaumburg, Ill.

[21] Appl. No.: 173,234

[22] Filed: Dec. 27, 1993

[51] Int. Cl.[6] ..... H01P 1/203

[52] U.S. Cl. ..... 333/204; 333/246

[58] Field of Search ..... 333/203–205, 333/219, 246, 33, 35

[56] References Cited

U.S. PATENT DOCUMENTS

| | | | |
|---|---|---|---|
| 3,451,015 | 6/1969 | Heath | 333/204 X |
| 3,745,489 | 7/1973 | Cristal et al. | 333/185 |
| 4,851,797 | 7/1989 | Nakamura | 333/134 |
| 5,136,269 | 8/1992 | Seitzer et al. | 333/204 |
| 5,187,459 | 2/1993 | Russell et al. | 333/204 |

FOREIGN PATENT DOCUMENTS

| | | | |
|---|---|---|---|
| 0116302 | 9/1981 | Japan | 333/204 |
| 0038001 | 3/1982 | Japan | 333/204 |
| 1709438 | 1/1992 | U.S.S.R. | 333/204 |

OTHER PUBLICATIONS

Cohn, "Parallel-Coupled Transmission-Line-Resonator Filters", IRE Trans. on Microwave Theory & Techniques, 1958, pp. 223–231.

An article entitled "Microstrip Tapped-Line Filter Design", by Joseph S. Wong, Member IEEE from IEEE Transactions on Microwave Theory and Techniques, vol. MTT-27, No. 1, Jan. 1979, pp. 44–50.

*Primary Examiner*—Seungsook Ham

*Attorney, Agent, or Firm*—Gregory J. Gorrie

[57] ABSTRACT

Microwave parallel coupled line filters with direct taps having improved rejection of undesired signals near the pass-band are disclosed. Improved rejection is achieved by controlling the transmission zeros created by the input and output direct taps. Performance is comparable to parallel coupled line filters having substantially more coupling sections. The method involves shifting the transmission zeros by changing the position of the direct taps along the resonator or changing the impedance of the open-circuited stub associated with each tap. Impedance transformers can be used to match back to the source and load impedances.

18 Claims, 8 Drawing Sheets

- PRIOR ART -

- PRIOR ART -

COUPLED LINE FILTER WITH IMPROVED OUT-OF-BAND REJECTION

LICENSE RIGHTS

The U.S. Government has a paid-up license in this invention and the right in limited circumstances to require the patent owner to license others on reasonable terms as provided for by the terms of contract No. N00123-92-C-0047 awarded by the United States Navy.

FIELD OF THE INVENTION

This invention relates in general to radio frequency electronic circuits that filter a group of signals from a mixture of signals, and more particularly to filters that use coupled lines as the filter elements.

BACKGROUND OF THE INVENTION

An electrical filter is a device designed to separate, pass or suppress a group of signals from a mixture of signals. Filters are basic electronic components used in the design of communication systems such as telephone, television, radar and computers.

As is known in the art, an RF filter circuit provides a relatively low insertion loss characteristic to all RF signals having a frequency corresponding to one of a first predetermined band of frequencies. The first predetermined band of frequencies is generally referred to as a pass-band of the filter circuit. The RF filter further provides a relatively high insertion loss characteristic to RF signals having a frequency corresponding to a second predetermined band of frequencies. This second predetermined band of frequencies is generally referred to as the stop-band of the filter circuit. The filter circuit may be provided having a combination of pass-bands and stop-bands to provide a filter circuit having low-pass, high-pass and band-pass filter characteristics all well known to those of skill in the art.

As is also known in the art, RF filter circuits provided from printed circuit fabrication techniques are preferred because of the low cost and simplicity of the manufacturing process. Printed circuit filters are provided from a plurality of strip conductors disposed on a substrate. Such filter circuits maybe provided for example in a microstrip configuration or in a strip line configuration as is well known in the art. In a particular class of printed circuit filters, referred to as coupled line filters, strip conductors are disposed on the substrate in proximity to one another such that coupling occurs .between adjacent portions of the strip conductors.

The impedance characteristics and the coupling between the strip conductors cooperate to provide RF filter circuits having desired pass-band and stop-band characteristics. Regardless of Whether coupled line filters are provided in microstrip or stripline configurations, the filter circuit generally includes strip conductors having regions with electrical pathlengths corresponding to some fraction of a wavelength at the desired frequency of operation (e.g., one-quarter or one-half wavelength). Moreover, the fractional wavelength coupling regions are disposed to provide a plurality of coupled line sections with each coupled line section of the filter typically having substantially identical length.

The filter characteristics ( i. e., insertion loss, bandwidth, pass-band, and slope of the .so-called filter skirts) are, among other things, directly related to the number of poles provided in the filter. For example, in the case of parallel coupled line filter, the number of poles is proportional to the number of coupling sections. Many coupling sections are needed to provide a filter having a narrow pass-band, sharp filter skirts and a stopband having a high insertion loss. Thus, a filter providing the aforementioned electrical characteristics will be a relatively large circuit. This is a major disadvantage since size and weight are important factors for today's electronic hardware.

Thus, what is needed is an improved filter that rejects unwanted signals close to the pass-band, and provides a narrow pass-band, sharp filter skirts and a stop-band having a high insertion loss, accomplished with fewer poles or coupling sections to maintain a compact size and low weight. What is further needed is method of rejecting unwanted signals close to the pass-band, and providing a narrow pass-band, sharp filter skirts and a stop-band having a high insertion loss, accomplished with fewer poles to maintain a compact size and low weight.

SUMMARY OF THE INVENTION

Accordingly, an advantage of the present invention is to provide a microwave filter circuit having a passband comprising a substrate having a first and second opposing surfaces, a ground plane conductor disposed over the second surface and a first strip conductor of a first electrical pathlength disposed on the first surface, the first strip conductor having first and second ends. The filter further comprises a second strip conductor of the first electrical pathlength disposed on the first surface in parallel to the first strip conductor. The second strip conductor has third and forth ends and the first and second strip conductors have a coupling region being less than half the first electrical pathlength. The filter further comprises a third strip conductor disposed approximately ninety degrees to the first strip conductor and coupled to the first strip conductor at a first predetermined distance from the first end, the third strip conductor causing a first transmission zero at a first zero frequency.

In a preferred embodiment, the filter further comprises a fourth strip conductor disposed approximately ninety degrees to the second strip conductor and coupled to the second strip conductor at a second predetermined distance from the fourth end of the second strip conductor. The fourth strip conductor causes a second transmission zero at a second zero frequency. In addition, the second predetermined distance has an electrical pathlength greater than a quarter-wavelength of a center frequency of the pass-band and equal to approximately a quarter-wavelength of the second zero frequency.

DETAILED DESCRIPTION OF THE DRAWINGS

Filter circuits can be viewed as a two-port network. In such a network, there is a transmission through the network when, for a finite input, there results an output. The network is said to have "zero" transmission when for when finite input, zero output occurs. The frequencies at which a two-port network yields zero output for a finite input are referred to in the art as the "zeros of transmission". Zeros of transmission play a major role in filter synthesis and design. In a two-port network, there are many ways of producing zeros of transmission. One possible way for preventing the input signal from reaching the output is by shorting together all transmission paths or by opening all transmission paths by means of series or parallel resonance. Another possibility is that signals transmitted by different paths cancel at the output.

Many times, unwanted signals are close to the passband of the desired filter response. In some cases, the rejection of these unwanted signals may be more important to a particular application than the ultimate rejection of the filter. Adding and controlling zeros in a filter response can substantially reduce these unwanted signals. Further, adding and controlling transmission zeros can reduce the number of poles required to achieve the rejection of undesired signals.

FIG. 1 through FIG. 9 illustrate microstrip representations of two-pole and three-pole microstrip parallel coupled line filters. Like reference numbers refer to similar items throughout the FIGURES. Those of skill in the art will understand that the filters illustrated in FIG. 1 through FIG. 10 illustrate only the general shape of conductor patterns that reside on the dielectric media. The specific dielectric media and the conductor material is not important to the present invention. For convenience or explanation, only MIC structures are illustrated, it being understood that filter elements spaced from one ground plane by suitable dielectric material could similarly be spaced from a second ground plane on the opposite side for MIC structures. In the preferred embodiments of the present invention shown in FIGS. 2–4 and 6–8, the substrate materials include dielectrics such as alumina ($Al_2O_3$), sapphire, diamond, gallium arsenide, silicon, beryllium oxide, or Teflon. The strip conductors preferably include gold alloy, silver alloy, or copper alloy.

Figure 1:
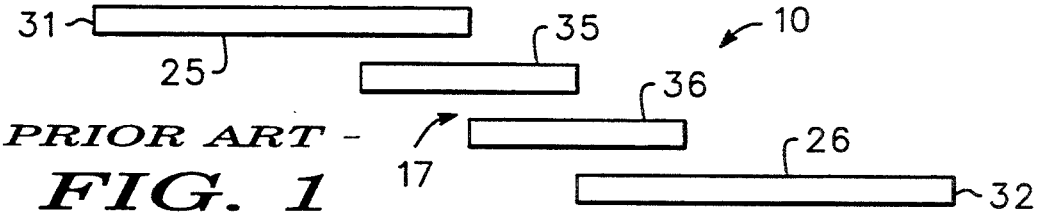
FIG. 1 illustrates a microstrip representation of a two-pole parallel coupled line filter.

The frequency response of a microwave filter (e.g. microstrip or stripline parallel coupled line filter, combline filter or inter digital filter) is determined by the length of the resonators, how tightly the resonators are coupled together and how tightly the input and output circuit is coupled. In addition, the frequency response depends on how the input and output circuit is coupled into the filter. FIG. 1 illustrates a two-pole parallel coupled line filter 10. Filter 10 has input port 31, output port 32, parallel resonators 35, 36 with coupling gap 17 and input/output end sections 25, 26. Filter 10 illustrates a conventional method of coupling input and output signals using parallel coupled sections 25, 26.

Figure 2:
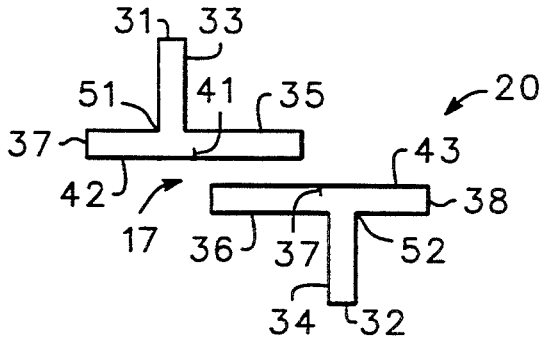
FIG. 2 illustrates a microstrip representation of a two-pole parallel coupled line filter with direct taps.

Direct taps are another method of coupling the input and output into and out of a filter. Direct taps can be visualized as open circuit stubs. When a direct tap is used on the input and output of a parallel coupled line filter, for example, two transmission zeros are created at a frequency where the length of the open circuited stub is equal to a quarter wave length. This configuration is illustrated in FIG. 2 for a half-wave parallel coupled line filter. Filters using direct taps are often referred to as tapped-line filters. Tapped line filters offer space and cost saving advantages over conventional filter types (for example, the filter of FIG. 1) because sections 25, 26 are eliminated. A further benefit is where the parallel coupling at end sections 25, 26 (FIG. 1) becomes very tight and the physical realization of the filter becomes impractical.

FIG. 2 shows a microstrip representation of two-pole coupled line filter 20 having parallel resonators 35, 36 with and coupling gap 17. Filter 20 has input port 31 and output port 32. Input and output ports 31, 32 are desirably matched to source and load impedances, respectively. Filter.20 has input direct tap 33 and output direct tap 34. Resonators 35, 36 are desirably approximately one-half the wavelength of the desired pass band center frequency of filter 20. Resonators 35, 36 typically have coupling region 53 of approximately a quarter-wavelength. Taps 33, 34 are located at tap points 51, 52, respectively, on resonators 35, 36, respectively. For convenience of explanation, the filter circuits of FIG. 1 through FIG. 4 are described in the case of port 31 as the input port, and port 32 as the output port; those of skill in the art will understand that input and output ports 31, 32 may be interchanged and the filter circuits of FIG. 1 through FIG. 4 will function substantially the same way.

Filter 10 (FIG. 1) and filter 20 (FIG. 2) have different out-of-band frequency responses because of the way the input and output is coupled to the filters. The frequency responses of filter 10 and filter 20 is shown in FIG. 10.

Figure 10:
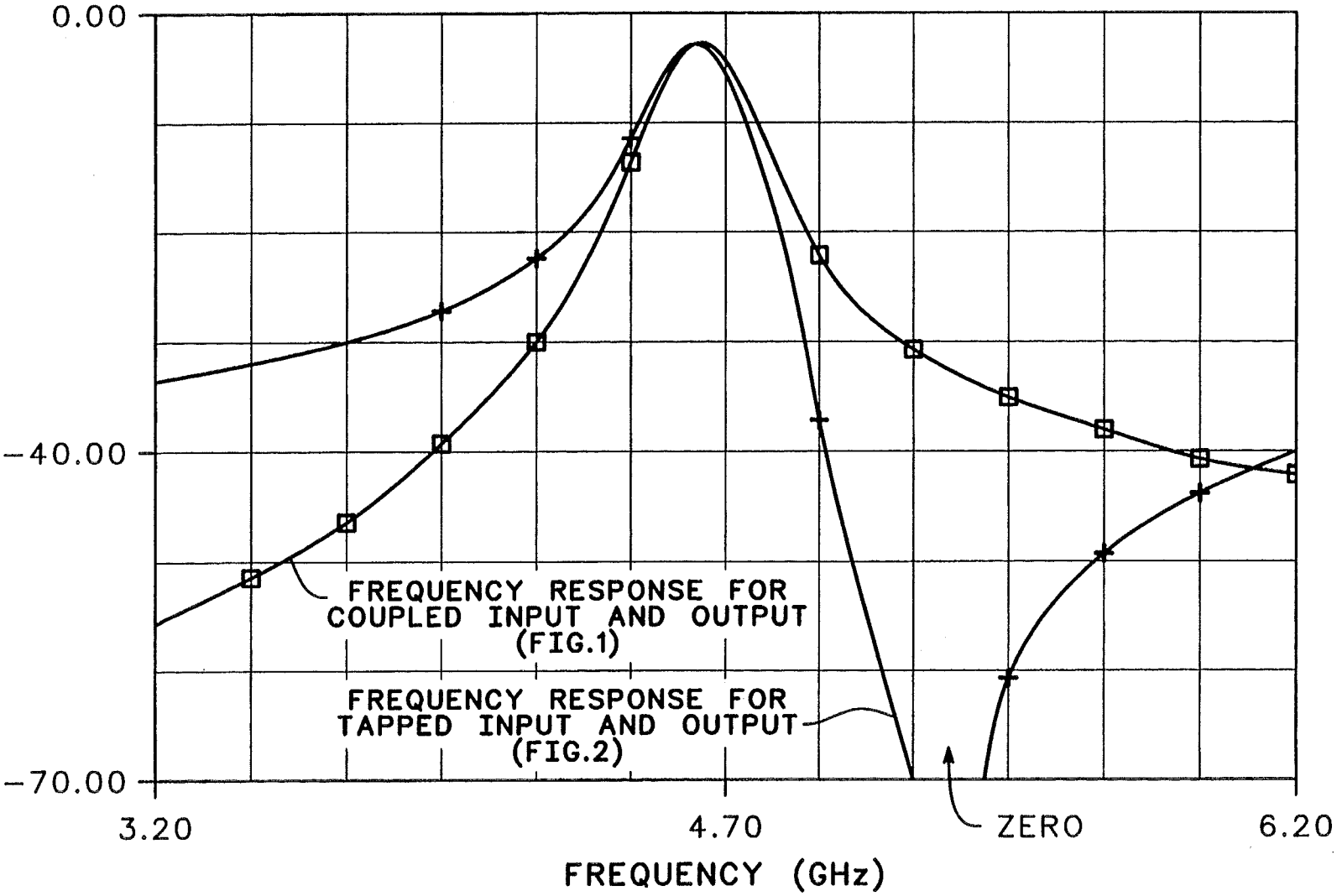
FIG. 10 shows a comparison between frequency responses of a two-pole parallel coupled line filter with a two-pole parallel coupled line filter with direct taps having transmission zeros above the pass band.
Figure 11:
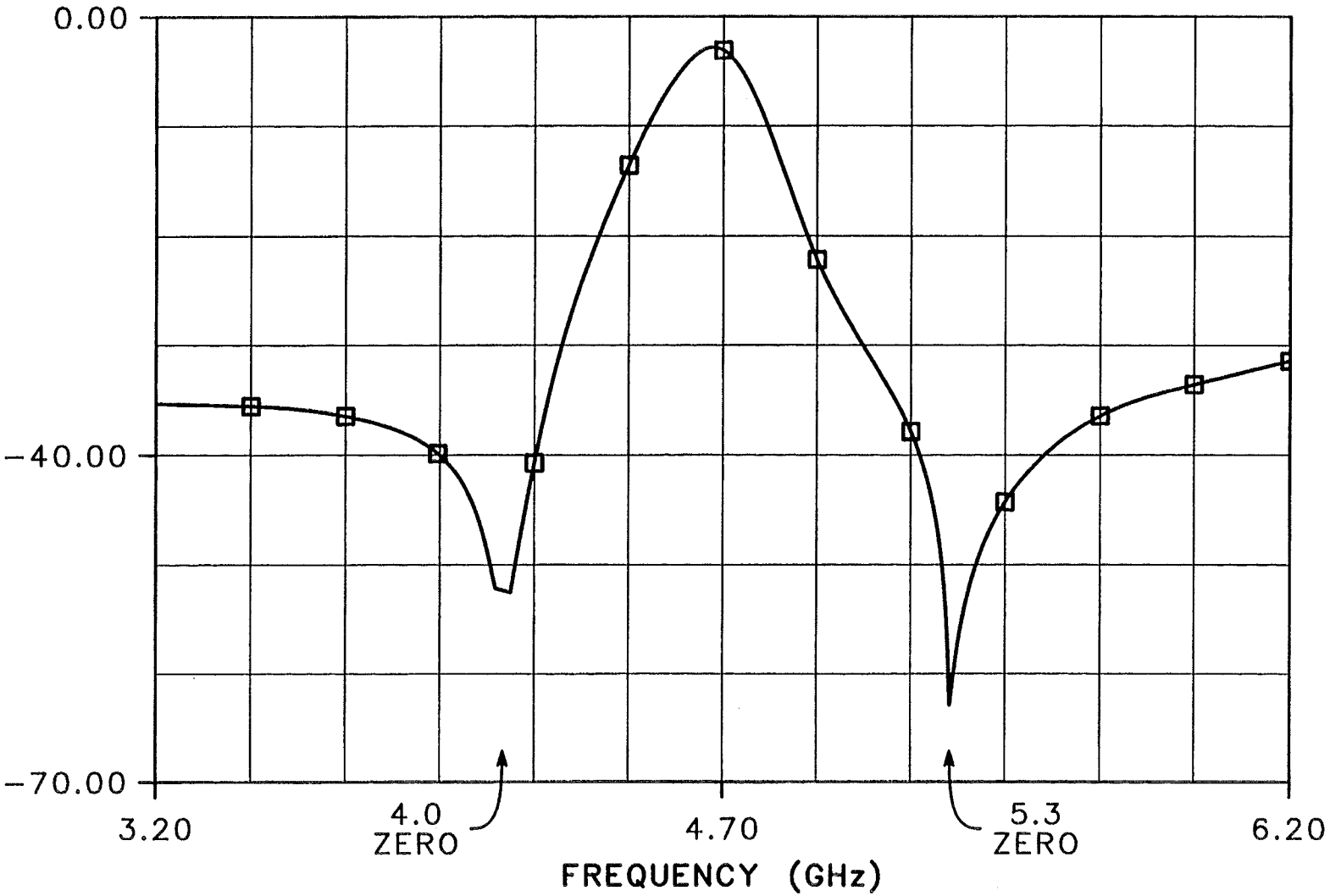
FIG. 11 shows the frequency response of a two-pole parallel coupled line filter with direct taps having a transmission zero shifted below the pass band.

FIG. 10 shows filter 10 and filter 20 having a pass-band at approximately 4.6 GHz. Filter 20 has improved rejection on the high-frequency side of the pass-band, but less rejection on the low-frequency side of the pass-band when compared to filter 10′ (See FIG. 11). The reason for the difference in response is that filter 20 uses input tap 33 while filter 10 uses parallel coupling end section 25 for coupling the input from input port 31. In addition, filter 20 uses output tap 34 while filter 10 uses parallel coupling end section 26 for coupling the output to output port 32. The direct taps 33, 34 of filter 20 each create a transmission zero. In FIG. 11, both zeros for filter 20 show up at approximately 5.3 GHz which is slightly higher than the center of pass band located at approximately 4.6 GHz. As shown in FIG. 10, at the zero frequency, there is greater than 70 dB rejection of signals.

The frequency of the first zero is determined when the length of open ended stub 42 measured from tap point 51 to end point 37 of resonator 35 of filter 20 becomes a quarter wavelength. The frequency of the second zero is determined when the length of open ended stub 43 measured from tap point 52 to end point 38 of resonator 36 of filter 20 becomes a quarter wavelength. The reason the zeros occur slightly above the pass-band (i.e., at around 5.3 GHz) is that the length of stubs 42, 43 is slightly less than a quarter-wavelength of the center frequency because tap points 51, 52 are shifted slightly from center points 41, 39 of resonators 35, 36 respectively.

The frequency of the transmission zeros can be controlled by changing the tap point location along the resonator to the position where the open circuited stub (i.e. the length to the end of the resonator) is a quarter wavelength at the frequency where a zero is desired. As the tap point is moved up the resonator decreasing the distance to ends 37 or 38 of resonators 35, 36, the filter impedance increases. If the impedance at the desired tap point differs from the source or load impedance, an impedance transformation would be required. Typically, as shown in FIG. 2, tap points are located at or near center points 41, 39 of resonators 35, 36 because the impedance at the center is equal to the resonator impedance.

Figure 3:
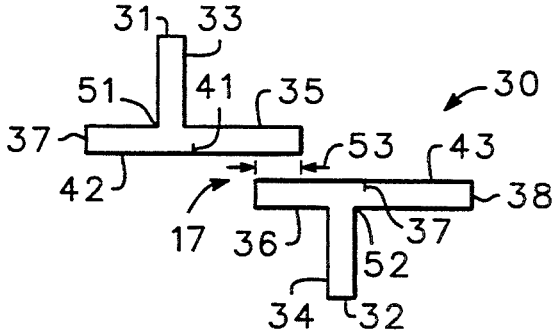
FIG. 3 illustrates a microstrip representation of a two-pole parallel coupled line filter with a shifted output tap in accordance with the present invention.

Output tap point 52 of filter 20 can be changed to move the transmission zero created by tap 34 to just below the pass-band. This is illustrated in FIG. 3 which shows filter 20 of FIG. 2 with shifted output tap 34. To move a transmission zero below the pass-band requires a quarter-wave stub that is slightly longer than one-half of the resonator length. The length of coupled section 53 is reduced from that of FIG. 2 so that resonator 36 can be tapped on the inside of the center line 39 (see FIG. 3). While the length of coupled section 53 is reduced, the total length of resonator 36 remains about the same. Coupling gap 17 may have to be decreased increasing the amount of coupling between resonators 35, 36 to maintain the same center frequency and bandwidth as filter 20 of FIG. 2. In addition, coupling region 53 will have to be reduced to slightly less than half the resonator length to maintain the center frequency and bandwidth as filter 20 of FIG. 2. FIG. 11 shows the response of filter 30. The shifted transmission zero in filter 30 produces a notch below the pass-band frequency response at approximately 4.0 GHz. The notch is located at the frequency at which the zero has been shifted to which is determined by the length of open-circuited stub 43. Note that the zero created by input tap 33 still remains at approximately 5.3 GHz.

The position of the zeros result in improved rejection of undesirable signals close in to the desired pass-band. The amount of rejection achieved near the pass band is accomplished with less coupling sections than prior art methods where the zero's of transmission are not controlled the use of less coupling sections is desired because of size and weight limitations. In many applications, it is necessary to reject a undesired signal near the pass-band. Examples of these situations occur in radar and communications systems where image frequencies are close in to the desired signal, or when local oscillator frequencies are close in to the desired signal.

Figure 4:
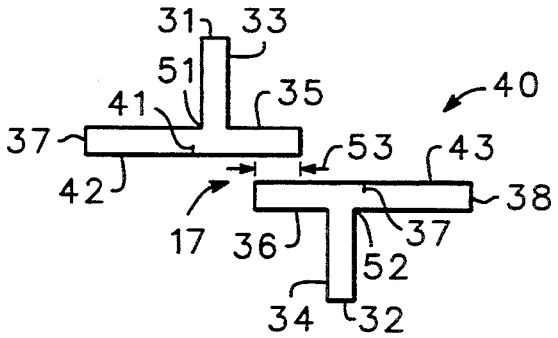
FIG. 4 illustrates a microstrip representation of a two-pole parallel coupled line filter with shifted input and output taps in accordance with the present invention.
Figure 12:
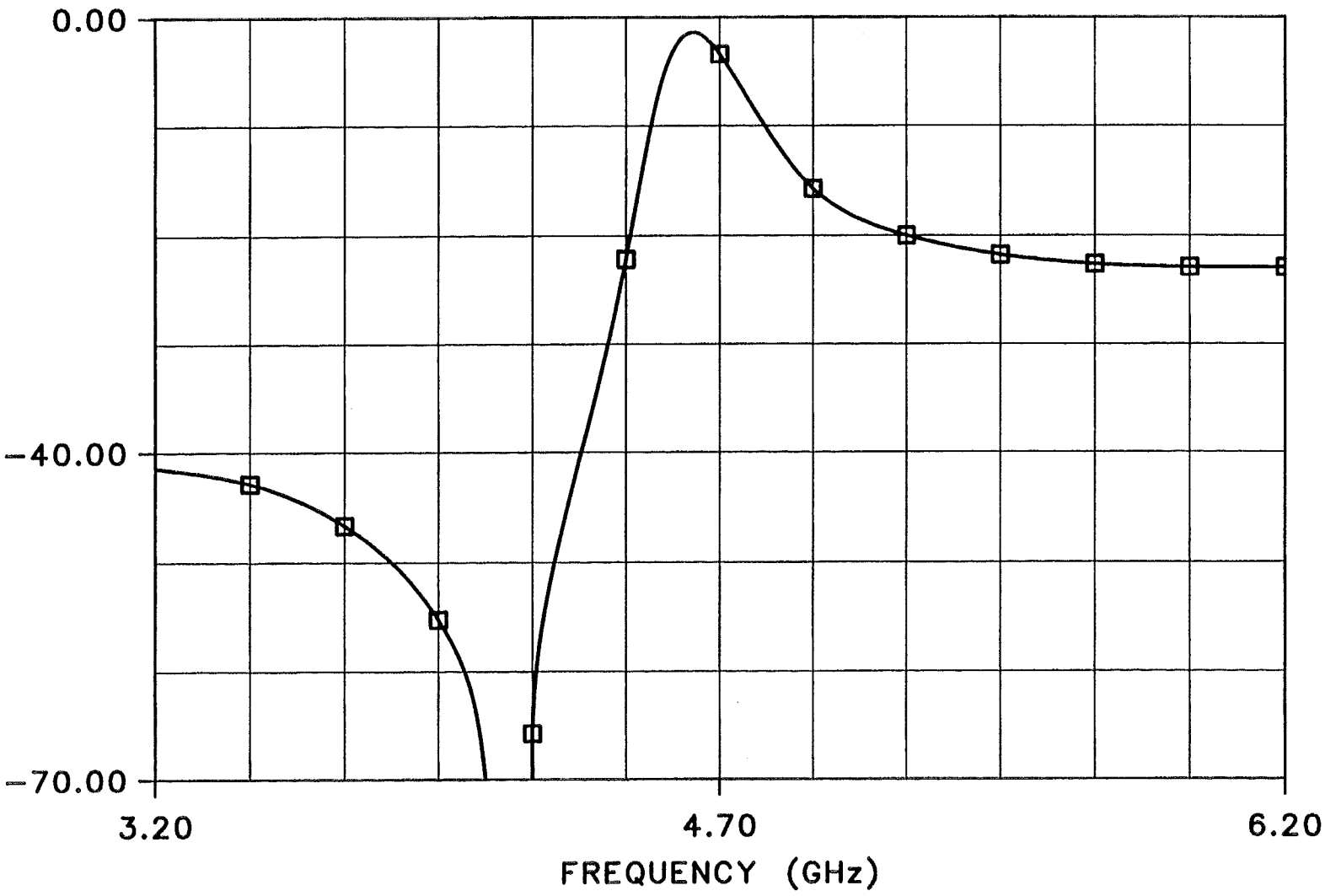
FIG. 12 shows the frequency response of a two-pole parallel coupled line filter with direct taps having both transmission zeros shifted below the pass band.

The transmission zero created by input direct tap 33 can also be shifted. Moving input tap 33 of FIG. 3 past center point 41 of resonator 35, moves the transmission zero below the pass-band. The resulting filter, filter 40, shown in FIG. 4 illustrates filter 30 of FIG. 3 with shifted input tap 33. Direct tap 33 of filter 30 has been moved past center-line 41 of resonator 35. This increases the length of open-circuited stub 42 to slightly greater than half the length of resonator 35. The zero shifts below the pass-band because the distance from tap point 51 to end point 37 of resonator 35 is increased, resulting in a shift to a lower frequency for the zero. To maintain similar pass-band response as that of filter 30, coupling gap 17 is reduced. Furthermore, coupling region 53 is also reduced. The response of filter 40 results in both transmission zeros shifted below the pass band of the filter response. The frequency response of filter 40 is shown in FIG. 12. Note that both zeros, the zero created by tap 33, and the zero created by tap 34, are located at approximately 4.1 GHz. This improved filter configuration further improves the out-of-band rejection of the filters of FIG. 2 and FIG. 3.

Figure 5:
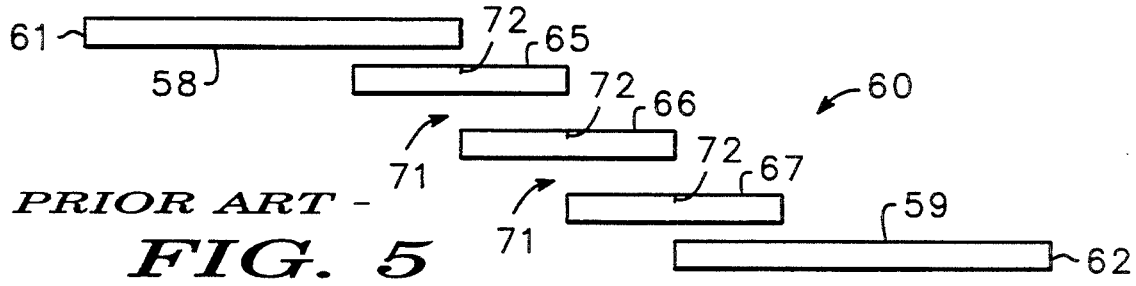
FIG. 5 illustrates a microstrip representation of a three-pole parallel coupled line.

Three-pole parallel coupled line filters can further illustrate the control transmission zeros. Three-pole parallel coupled line filters 60, 70, 80 and 90 are shown in FIG. 5, FIG. 6, FIG. 7, and FIG. 8, respectively. Filters 60, 70, 80 and 90 have input 61, output 62, parallel resonators 65, 66 and 67, and coupling gaps 71. Resonators 65, 66 and 67 have center points 72. Filter 60 (FIG. 5) has parallel coupling sections 58, 59 to couple signals to the input 61 and output 62 ports, respectively. Filters 70, 80 and 90 (FIG. 6) have input direct tap 63 and output direct tap 64 in place of parallel coupling sections 58, 59 of filter 60 (FIG. 5). For convenience of explanation, the filter circuits of FIG. 5 through FIG. 8 are described in the case of port 61 as the input port, and port 62 as the output port; those of skill in the art will understand that input and output ports 61, 62 may be interchanged and the filter circuits will function substantially the same way.

Figure 6:
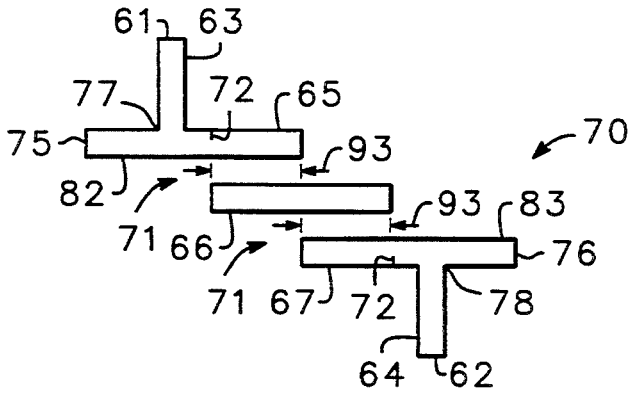
FIG. 6 illustrates a microstrip representation of a three-pole parallel coupled line filter with direct taps.
Figure 13:
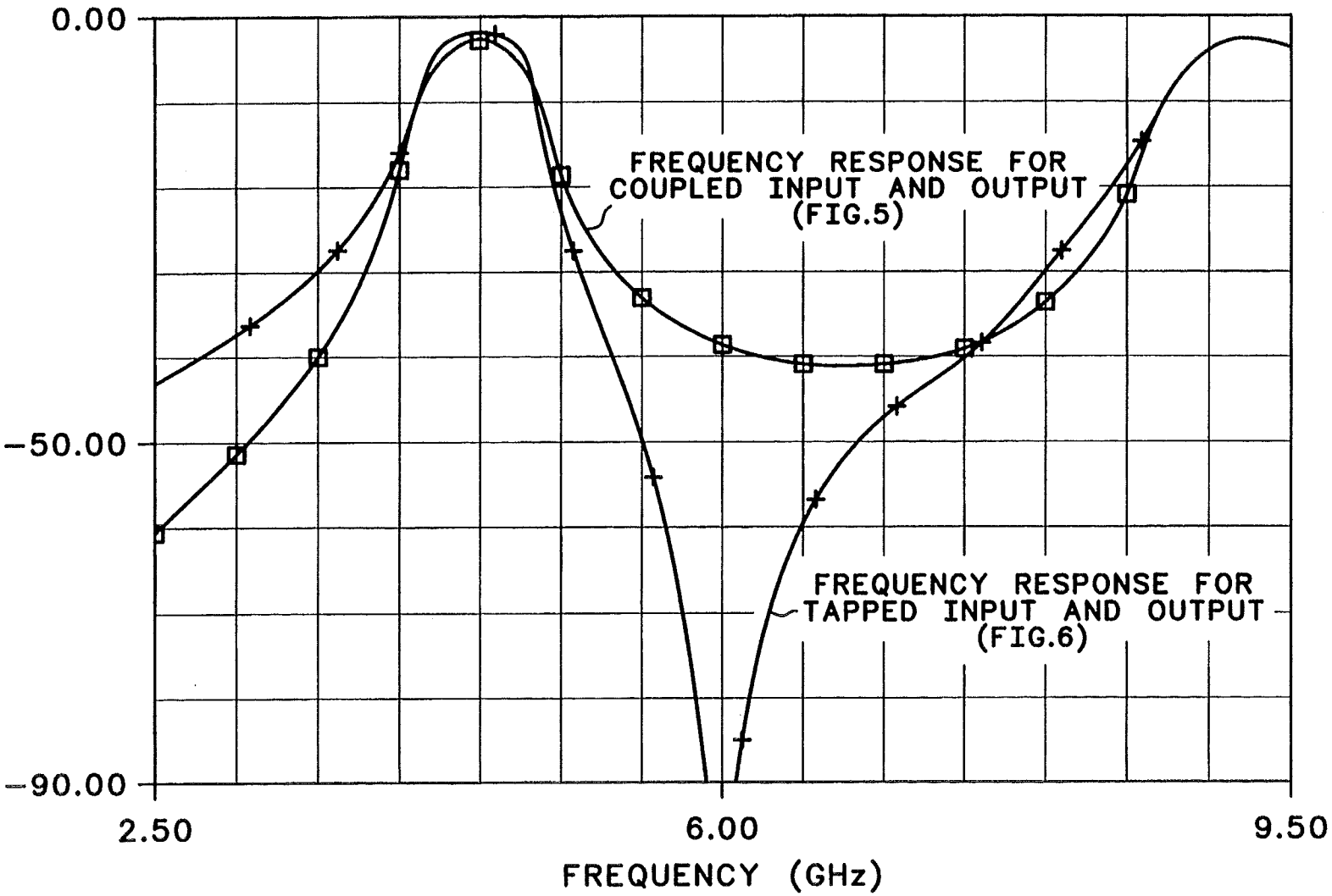
FIG. 13 shows comparison between frequency responses of a three-pole parallel coupled line filter with a three-pole parallel coupled line filter with direct taps having transmission zeros above the pass band.

FIG. 6 shows direct taped filter 70. Filter 70 has coupling regions 93 equal to approximately half the resonator length. Direct taps 63, 64 of filter 70 (see FIG. 6) each create a transmission zero located at a frequency where the distance to end points 75, 76 from tap points 77, 78 is a quarter-wavelength. FIG. 13 shows a comparison between the frequency responses of filter 60 (FIG. 5) having parallel coupling input and output sections, and filter 70 (FIG. 6) having direct taps. Filter 60 and filter 70 both have pass-bands at approximately 4.5 GHz center frequency. The zero's created by direct taps 63, 64 of filter 70 are located at approximately 6.0 to 6.1 GHz. Filter 70 has significantly better out-of-band rejection than filter 60 (FIG. 5) at the zero frequency. FIG. 13 shows that at the zero frequencies, greater than 90 dB of rejection is achieved.

To shift one of the transmission zeros of filter 70 created by either input tap 63, or output tap 64 to another frequency where rejection is desired, the length of a quarter-wave stub at the higher out-of-band frequency in the dielectric media that the filter is constructed on is calculated. In the case of input tap 63, the stub length is the distance from tap point 77 on resonator 65, to end point 75. In the case of output tap 64, the stub length is the distance from tap point 78 on resonator 67, to end point 76. Typical dielectric medias may include, but are not limited to duroid, ceramic, E-10 board, etc. Those of skill in the art will understand that the specific dielectric media is not important to the present invention.

For example in the case of filter 70, to move a zero from approximately 6.1 GHz, to approximately 7.1 GHz, the length for a quarter wave stub at 7.1 GHz in the dielectric media that the filter is constructed on is first calculated. Equation (1) is then used to find the approximate impedance at that point.

$$\text{Impedance}=2*Qsh*Z_o*S1N^2(\pi/2L)/\pi \qquad \text{Equation (1)}$$

Figure 7:
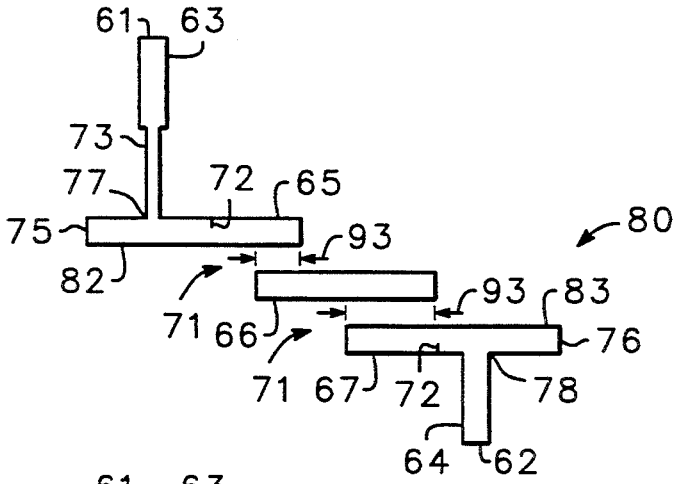
FIG. 7 is illustrates a microstrip representation of a three-pole parallel coupled line filter with direct taps with an input impedance transformer in accordance with a preferred embodiment of the present invention.

Where: $Qsh=q^1*F_o/(BW_{ripple})$; $q^1$=Low pass proto type value; $F_o$=Filter center frequency; $BW_{ripple}$=Filter ripple bandwidth; $Z_o$=Resonator impedance; L=Half wavelength of input resonator; and d=Tap point distance from center of resonator. Using the calculated impedance from Equation (1), a quarter wave transformer is required to transform the impedance at the tap location back to the load and source impedance. FIG. 7 shows filter 80 which illustrates filter 70 of FIG. 6 where input tap 63 has been moved toward open circuited-end 75 of resonator 65 using this method. In addition, tap 63 is shown with impedance transformer 73. Impedance transformer 73, located at tap point 77, transforms the higher impedance at tap point 77 back to the source impedance. The distance from tap point 77 to end 75 of resonator 65 is approximately a quarter-wavelength at the frequency of where the transmission zero has been shifted to. Filter 80 will have improved out-of-band rejection at this frequency.

Figure 14:
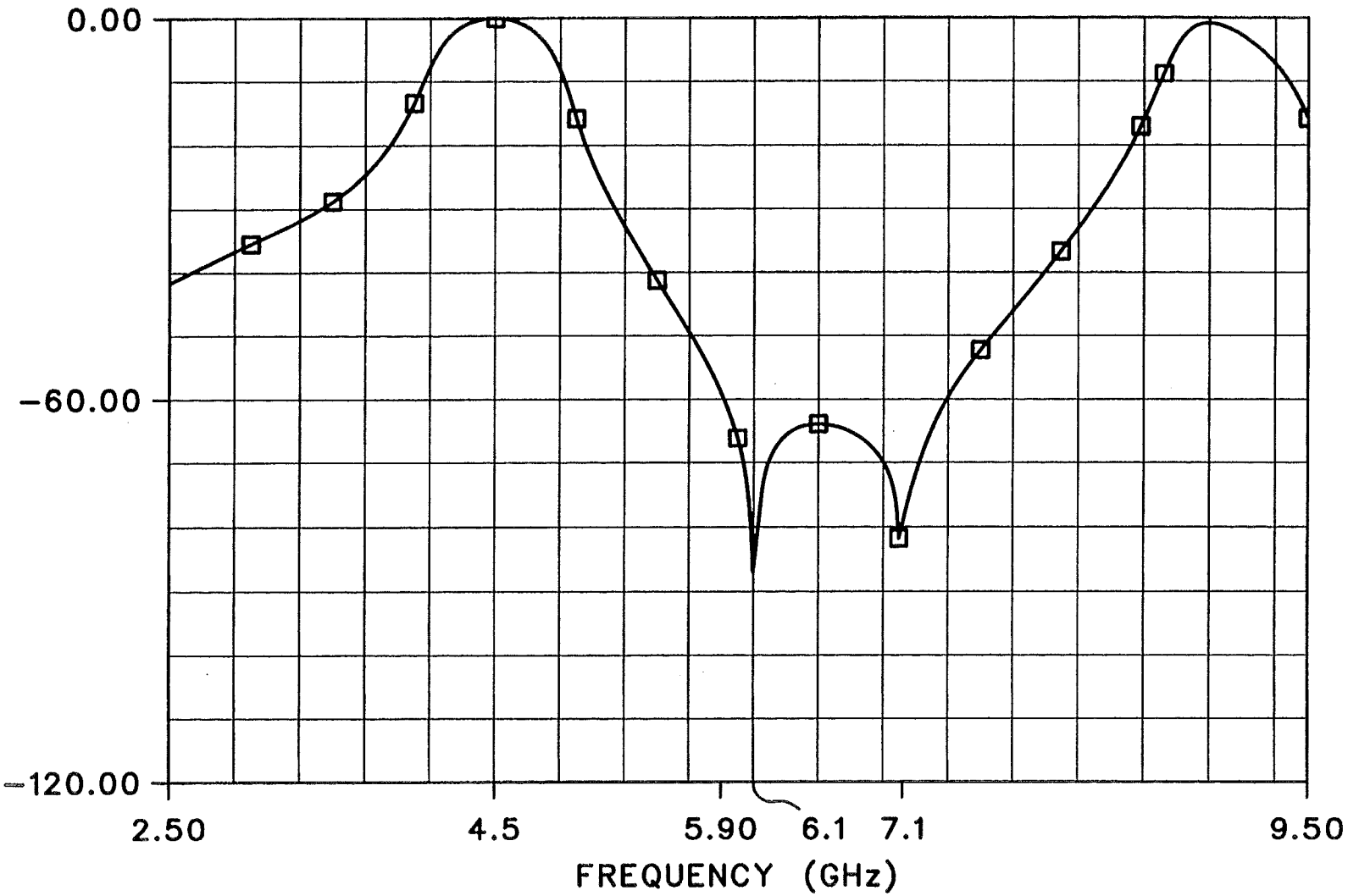
FIG. 14 shows the frequency response of a three-pole parallel coupled line filter with direct taps having a transmission zero shifted up in frequency.

FIG. 14 shows a typical frequency response of filter 80 (FIG. 7). The zero created by output tap 64 remains at approximately 6.1 GHz, while the zero created by input tap 63 has been shifted up to approximately 7.1 GHz. To maintain the same pass-band as that of filter 70 (FIG. 6) in filter 80 (FIG. 7), coupling regions and/or coupling gaps 71 may have to be reduced.

Figure 8:
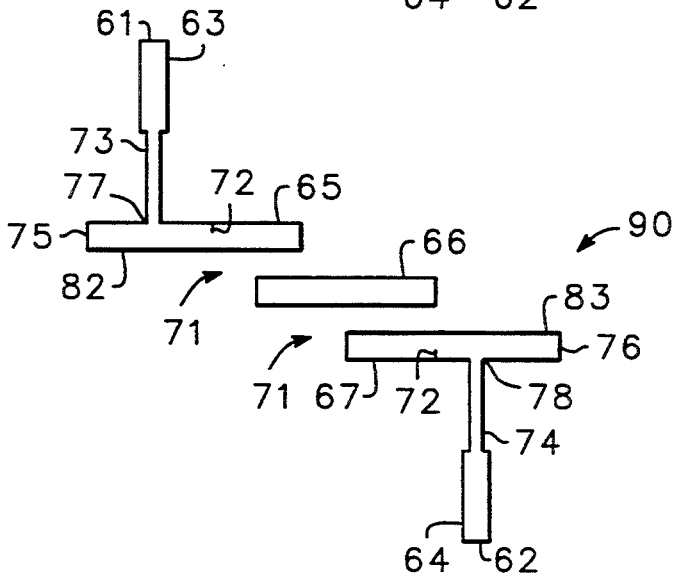
FIG. 8 is illustrates a microstrip representation of a three-pole parallel coupled line filter with direct taps with input and output impedance transformers in accordance with a preferred embodiment of the present invention.

The same process can be followed to shift the transmission zero created by output direct tap 64. FIG. 8 shows filter 90 which illustrates filter 80 of FIG. 7 having shifted output tap 64 with output impedance transformer 74. The load impedance is desirably matched to the impedance at tap point 78 for output direct tap 64. Shifting the zero created by output tap 64 to a higher frequency (compared to that of filter 70 (FIG. 6)) further improves the out-of-band rejection at/around the zero frequency. To maintain the same pass-band as that of filter 80 (FIG. 7) in filter 90 (FIG. 8), coupling regions and/or coupling gaps 71 may have to be further reduced from that of filter 80 (FIG. 8).

Figure 9:
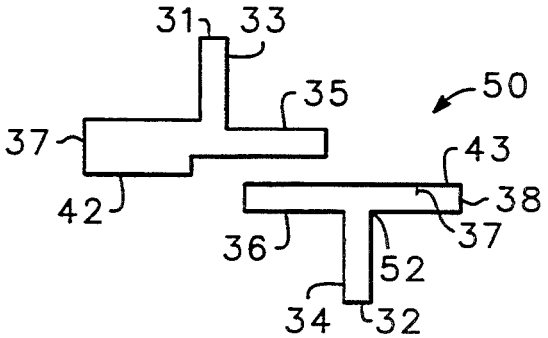
FIG. 9 is illustrates a microstrip representation of a two-pole parallel coupled line filter with direct taps with a low impedance resonator end in accordance with a preferred embodiment of the present invention.

FIG. 9 illustrates another method of controlling transmission zeros. FIG. 9 shows a two-pole parallel coupled filter with direct taps similar to that of FIG. 2. The zeros created by taps 33, 34 can be moved in frequency by changing the impedance of the open circuited section of transmission line (i.e., open-circuited stubs 42, 43) while maintaining the same reactance at the tap point. FIG. 9 shows resonator 35 widened on open-circuited end 37. The widened resonator end results in a change to the electrical length of open circuit stub section 42 and thus changes the frequency of the transmission zero created by tap 33. The tap point of direct tap 33 remains at the low impedance (e.g., 50 Ohm) point on resonator 35 which is near the center of the resonator, but the width and length of the open circuited end 42 of resonator 35 is changed to control the transmission zero. The reactance of open circuited stub 42 would remain constant.

Figure 15:
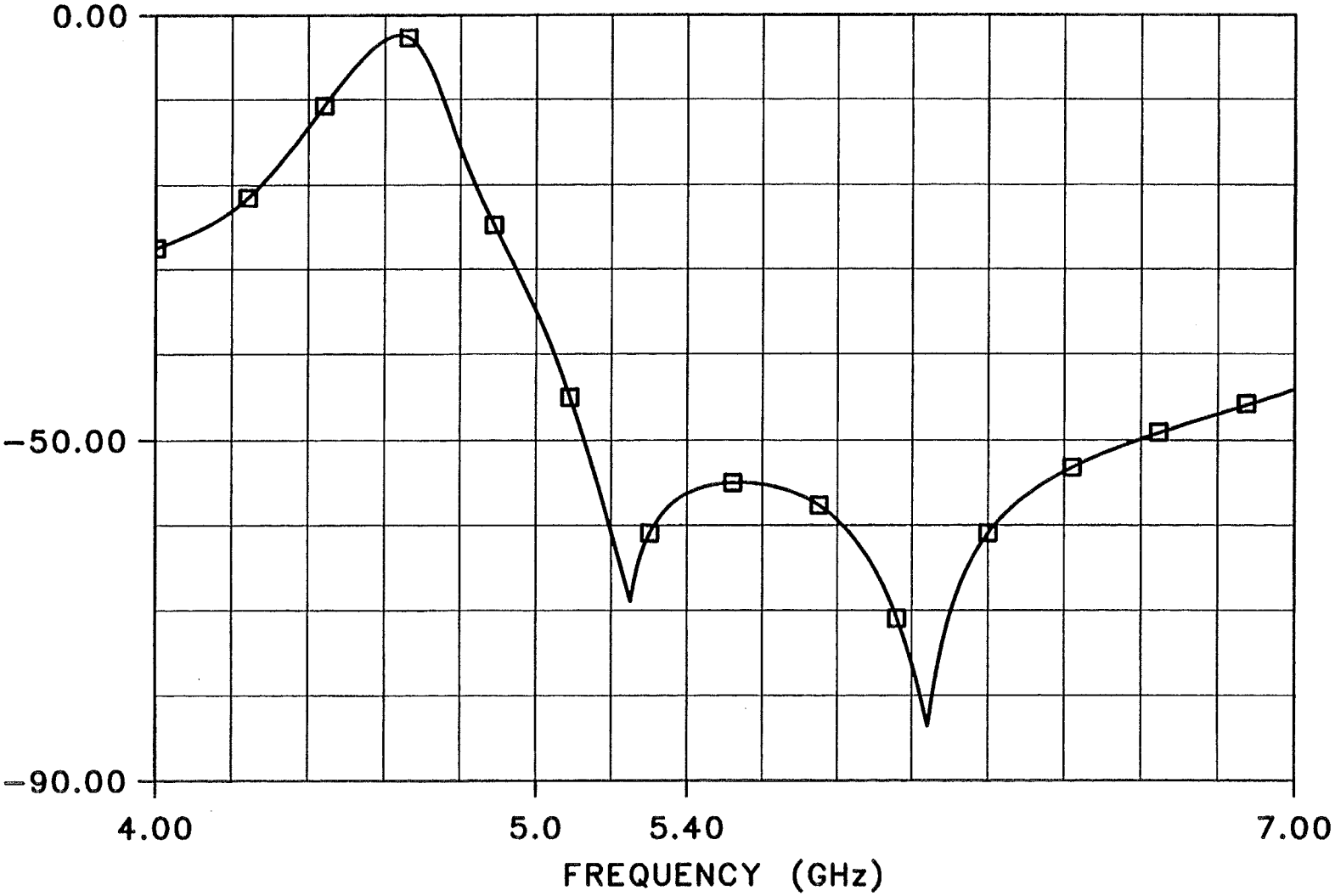
FIG. 15 shows the frequency response of a two-pole parallel coupled line filter with direct taps having a transmission zero shifted up in frequency by changing the resonator impedance.

The typical frequency response for filter 50 (shown in FIG. 15) shows improved out of band rejection at each zero. The zero created by output tap 34 is located at approximately 5.3 GHz, while the zero created by input tap 33 has been shifted to approximately 6.1 due to the change in the impedance of stub 42. FIG. 9 shows section 42 being a low impedance section (i.e., wider line width/shorter length) but high impedance sections (e.g., narrower line width/longer length) can also be used, for example where it is desired to shift the transmission zero below the filter pass band. The same procedure can be followed for shifting the transmission zero created by output tap 34 by changing the width of open-ended stub 43 of resonator 36.

In a preferred embodiment, a combination of shifting direct taps, using impedance transformers, and changing the width of open circuited stubs is desirably used for controlling transmission zeros.

Thus, a method and apparatus for shifting transmission zeros in parallel coupled filters has been described. The present invention provides an improved parallel coupled filter that rejects unwanted signals close to the pass-band, and provides a narrow pass-band, sharp filter skirts and a stop-band having a high insertion loss. This is accomplished with fewer poles or coupling sections than prior art filters and maintains a compact size and low weight.

It overcomes the problem of providing a compact coupled filter having comparable performance of a multi-pole filter with fewer coupling sections relative to prior art methods and mechanisms. The improvements over known technology are significant. The expense, complexities, and high cost of using filters with a high number of poles or coupling sections is avoided.

The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What is claimed is:

1. A microwave filter circuit comprising:

a substrate having a first and second opposing surfaces;

a ground plane conductor disposed over said second surface;

a first strip conductor of a first electrical pathlength disposed on said first surface, said first strip conductor having first and second ends;

a second strip conductor of said first electrical pathlength disposed on said first surface in parallel to said first strip conductor, said second strip conductor having third and forth ends, said first and second strip conductors having a coupling region being less than half said first electrical pathlength; and a third strip conductor positioned approximately ninety degrees to said first strip conductor and coupled to said first strip conductor at a first distance from said first end, said first distance being greater than one half of said first electrical pathlength, said third strip conductor causing a first transmission zero at a first zero frequency, said first zero frequency being below a pass-band of said filter circuit.

2. A filter according to claim 1 wherein said first distance has an electrical path-length greater than a quarter-wavelength of a center frequency of said pass-band and equal to approximately a quarter-wavelength of said first zero frequency, and wherein said coupling region is less than a quarter-wavelength of said center frequency of said pass-band.

3. A filter according to claim 2 further comprising a fourth strip conductor positioned approximately ninety degrees to said second strip conductor and coupled to said second strip conductor at a second distance from said fourth end of said second strip conductor, said second distance being less than one half of said first electrical pathlength, said fourth strip conductor causing a second transmission zero at a second zero frequency, said second zero frequency being above said pass-band of said filter circuit.

4. A filter according to claim 3 wherein said second distance has an electrical path-length less than a quarter-wavelength of a center frequency of said pass-band and equal to approximately a quarter-wavelength of said second zero frequency.

5. A filter according to claim 4 wherein said first and second strip conductors are spaced a first predetermined distance apart, said first electrical pathlength is substantially a half-wavelength of a center frequency of said pass-band.

6. A filter according to claim 1 wherein said coupling region is less than a quarter-wavelength of a center frequency of said pass-band.

7. A filter according to claim 5 wherein said first distance has an electrical path-length greater than a quarter-wavelength of a center frequency of said pass-band and equal to approximately a quarter-wavelength of said first zero frequency and said third strip conductor has a quarter-wave transformer section that includes a high impedance section adjacent to said second strip conductor.

8. A filter according to claim 7 wherein said second distance has an electrical path-length less than a quarter-wavelength of a center frequency of said pass-band and equal to approximately a quarter-wavelength of said second zero frequency and said fourth strip conductor has a quarter-wave transformer section that includes a high impedance section adjacent to said second strip conductor.

9. A filter according to claim 5 wherein said first strip conductor has a wider portion from said first end to said third strip conductor.

10. A filter according to claim 5 wherein said first strip conductor has a narrow portion from said first end to said third strip conductor.

11. A filter according to claim 5 wherein said second strip conductor has a wider portion from said fourth end to said fourth strip conductor.

12. A filter according to claim 5 wherein said second strip conductor has a narrow portion from said fourth end to said fourth strip conductor.

13. A filter according to claim 1 wherein said substrate is a dielectric material consisting of alumina ($Al_2O_3$), sapphire, diamond, gallium arsenide, silicon, beryllium oxide, or Teflon.

14. A filter according to claim 1 wherein said strip conductors consist of gold alloy, silver alloy, or copper alloy.

15. A method of controlling transmission zeros of a filter circuit having parallel coupled resonators, said method comprising:

providing a first strip conductor of a first electrical pathlength disposed on a substrate, said first strip conductor having first and second ends;

providing a second strip conductor of said first electrical pathlength disposed on said substrate in parallel to said first strip conductor, said second strip conductor having third and forth ends, said first and second strip conductors having a coupling region being less than half said first electrical pathlength; and providing a third strip conductor at approximately ninety degrees to said first strip conductor, said third strip conductor coupled to said first strip conductor at a distance from said first end, said distance being greater than one half of said first electrical pathlength, said third strip conductor creating a transmission zero at a zero frequency, said zero frequency being below a pass-band of said filter circuit.

16. A method according to claim 15 further comprising the steps of: reducing said coupling region; and reducing a coupling gap between said first and second strip conductors, said reducing steps maintaining a pass band of said filter.

17. A method according to claim 15 further comprising the step of:

providing a fourth strip conductor disposed approximately ninety degrees to said second strip conductor and coupled to said second strip conductor at a second distance from said fourth end of said second strip conductor, said distance being less than half of said first electrical pathlength said fourth strip conductor creating a second transmission zero at a second zero frequency, wherein said second zero frequency is above said pass-band.

18. A parallel-coupled transmission-line filter comprising:

a first strip conductor of a first length having first and second ends;

a second transmission line of said first length having third and forth ends, said first and second transmission lines having a coupling region being less than half said first electrical pathlength;

a third transmission line positioned approximately ninety degrees to said first transmission line and coupled to said first transmission line at a first distance from said first end, said first distance being greater than one half of said first length, said third transmission line causing a first transmission zero at a first zero frequency, said first zero frequency being below a pass-band of said filter circuit; and a fourth transmission line positioned approximately ninety degrees to said second transmission line and coupled to said second transmission line at a second distance from said fourth end of said second transmission line, said second distance being less than one half of said first length, said fourth transmission line causing a second transmission zero at a second zero frequency, said second zero frequency being above said pass-band of said filter circuit.

* * * * *